US008795451B2

(12) United States Patent
Müller et al.

(10) Patent No.: US 8,795,451 B2
(45) Date of Patent: Aug. 5, 2014

(54) PROPELLANT AND PROCESS FOR PRODUCING A PROPELLANT

(75) Inventors: Dietmar Müller, Karlsruhe (DE); Walter Langlotz, Henfenfeld (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 58 days.

(21) Appl. No.: 13/110,158

(22) Filed: May 18, 2011

(65) Prior Publication Data

US 2011/0284140 A1 Nov. 24, 2011

(30) Foreign Application Priority Data

May 18, 2010 (DE) ..... 10 2010 020 776

(51) Int. Cl.

| | |
|---|---|
| ***C06B 25/00*** | (2006.01) |
| ***C06B 25/18*** | (2006.01) |
| ***C06B 25/02*** | (2006.01) |
| ***D03D 23/00*** | (2006.01) |
| ***D03D 43/00*** | (2006.01) |

(52) U.S. Cl.
USPC ..... 149/96; 149/88; 149/99; 149/109.2; 149/109.4

(58) Field of Classification Search
USPC ..... 149/64, 88, 96, 99, 109.2, 109.4
See application file for complete search history.

(56) References Cited

U.S. PATENT DOCUMENTS

| | | | | |
|---|---|---|---|---|
| 5,266,242 | A | 11/1993 | Mogendorf et al. | |
| 5,487,851 | A * | 1/1996 | Dillehay et al. | 264/3.3 |
| 5,500,060 | A * | 3/1996 | Holt et al. | 149/19.1 |
| 5,507,891 | A * | 4/1996 | Zeigler | 149/47 |
| 5,520,756 | A | 5/1996 | Zeigler | |
| 6,170,868 | B1 * | 1/2001 | Butt et al. | 280/737 |
| 6,241,833 | B1 | 6/2001 | Brown | |
| 6,309,484 | B2 | 10/2001 | Langlotz et al. | |
| 6,368,431 | B1 * | 4/2002 | Mangum et al. | 149/19.7 |
| 6,984,275 | B1 * | 1/2006 | Walsh et al. | 149/19.7 |
| 2001/0017175 | A1 | 8/2001 | Mangum et al. | |

FOREIGN PATENT DOCUMENTS

| | | | |
|---|---|---|---|
| DE | 37 44 680 | A1 | 11/1991 |
| DE | 699 06 978 | T2 | 4/2004 |
| DE | 10 2004 004 529 | A1 | 8/2004 |
| DE | 10 2005 037 017 | A1 | 2/2007 |
| EP | 0490258 | A1 | 6/1992 |
| EP | 0 960 083 | A1 | 12/1999 |
| EP | 1932817 | A1 | 6/2008 |
| FR | 2680782 | A1 | 3/1993 |
| GB | 2258230 | A | 2/1993 |
| WO | 9013528 | A2 | 11/1990 |
| WO | 95/17358 | A1 | 6/1995 |
| WO | 0003960 | A1 | 1/2000 |

* cited by examiner

*Primary Examiner* — James McDonough
(74) *Attorney, Agent, or Firm* — Laurence A. Greenberg; Werner H. Stemer; Ralph E. Locher

(57) ABSTRACT

A propellant for guns includes at least one energy carrier, nitrocellulose and cellulose acetate butyrate. At least part of the nitrocellulose is alcohol-soluble nitrocellulose. The nitrocellulose serves as a binder and for that purpose is present in a concentration of at least 15% by weight in the propellant. A process for producing a propellant is also provided.

33 Claims, No Drawings

PROPELLANT AND PROCESS FOR PRODUCING A PROPELLANT

CROSS-REFERENCE TO RELATED APPLICATION

This application claims the priority, under 35 U.S.C. §119, of German Patent Application DE 10 2010 020 776.4-45, filed May 18, 2010; the prior application is herewith incorporated by reference in its entirety.

BACKGROUND OF THE INVENTION

Field of the Invention

The invention relates to a propellant (P) for guns or revolvers, which includes at least one energy carrier, nitrocellulose (NC) and cellulose acetate butyrate (CAB). The invention also relates to a process for producing a propellant.

European Patent EP 0 960 083 B1, corresponding to U.S. Pat. No. 6,309,484, discloses a propellant powder for guns which includes a plasticizer based on nitramine and an energy-rich or not energy-rich polymer binder. The plasticizer is a mixture of at least three chemically different dinitrodiaza compounds. The binder which is not energy-rich can be cellulose acetate butyrate. Due to the properties of the plasticizer, such a propellant powder allows firing of gun ammunition with virtually constant values of maximum pressure and projectile velocity in the entire temperature range from −50° C. to +70° C.

International Publication No. WO 95/17358, corresponding to U.S. Pat. Nos. 5,487,851 and 5,565,150, discloses a propellant mixture for firearms which displays a high resistance to unintentional ignition due to heat, flame, impact, friction and chemical influences. It contains RDX together with cellulose acetate butyrate, nitrocellulose, ethyl centralite, a moisture binder and an energy-rich plasticizer. During manufacture, the ingredients are moistened with an ethyl acetate/ethyl alcohol mixture or, in the case of cellulose acetate butyrate and nitrocellulose, dissolved therein. The ethyl acetate/ethyl alcohol mixture serves to keep the composition mixable and able to be extruded through an extruder. The nitrocellulose is present in a proportion of from 2% by weight to 6.3% by weight in the propellant mixture. It serves to make the propellant mixture tough. Cellulose acetate butyrate serves as a binder and is present in a concentration of from 10% by weight to 15% by weight. The propellant is relatively expensive to produce.

SUMMARY OF THE INVENTION

It is accordingly an object of the invention to provide a propellant and a process for producing a propellant, which overcome the hereinafore-mentioned disadvantages of the heretofore-known propellants and processes of this general type.

With the foregoing and other objects in view there is provided, in accordance with the invention, a propellant for guns. The propellant comprises at least one energy carrier, cellulose acetate butyrate and nitrocellulose. The energy carrier is not the nitrocellulose. At least part of the nitrocellulose is alcohol-soluble nitrocellulose and the nitrocellulose is present in a concentration of at least 15% by weight in the propellant to serve as a binder.

In the prior art, nitrocellulose is used in a significantly lower proportion of the total weight of the propellant. It usually serves to improve the ignitability, but not as binder. In order to produce an insensitive propellant having an increased explosion temperature and favorable cook-off behavior, it has been found to be advantageous to add cellulose acetate butyrate to the nitrocellulose. In the determination of the cook-off temperature, the temperature is increased stepwise in a defined manner until a reaction occurs in the form of burning, deflagration or detonation. The cook-off behavior is more favorable, the higher the temperature at which the reaction commences. In the case of ageing of the propellant, the cellulose acetate butyrate also improves the heat flow. Local overheating in the propellant is prevented thereby. That is particularly advantageous when ammunition containing the propellant is used in hot regions where the ammunition is frequently exposed to temperatures of from 60 to 70° C. in vehicles. However, the inventors have found that the propellant becomes relatively brittle when the cellulose acetate butyrate content is increased to above 2% by weight, so that there is a risk of brittle fracture. Nitrocellulose is soluble in alcohols, esters or ketones, depending on the degree of esterification. There is nitrocellulose which is soluble in acetone but not in alcohol. However, nitrocellulose which is soluble in alcohol is always also soluble in acetone or ethyl acetate. For the purposes of the present invention, an acetone-soluble nitrocellulose is always a nitrocellulose which is not alcohol-soluble. For the purposes of the present invention, the term alcohol is generally understood to be ethanol.

It has hereto been customary to use acetone-soluble nitrocellulose for propellants. The inventors have found that when using an alcohol-soluble nitrocellulose at cellulose acetate butyrate concentrations above 2% by weight, a significantly less brittle propellant is obtained than when using acetone-soluble nitrocellulose. The risk of brittle fracture is significantly reduced thereby. The increased cellulose acetate butyrate content improves the thermal properties of the propellant by increasing the explosion temperature and the cook-off temperature and reduces the sensitivity to shock, friction and the effect of projectile impacts, hollow charges and splinters.

Furthermore, the increased cellulose acetate butyrate content makes it possible to produce propellants having different energy densities which are required depending on the field of use. The energy density can be adjusted from about 900 J/g to about 1350 J/g. Furthermore, the combustion temperature (adiabatic flame temperature) can be reduced by from about 500 K to 600 K, compared to propellants having the same energy density, through the use of the increased cellulose acetate butyrate content. As a result of the reduced combustion temperature, the propellant displays greatly reduced erosion behavior in use, i.e. there is reduced abrasion of material in the barrel of the gun during motion of the projectile in the barrel.

It is possible to use exclusively alcohol-soluble nitrocellulose or a mixture of alcohol-soluble and acetone-soluble nitrocellulose. The acetone-soluble nitrocellulose is usually supplied in alcohol-moist form while the alcohol-soluble nitrocellulose is usually supplied in water-moist form. Alcohol-soluble nitrocellulose has heretofore been used mainly in the paint and varnish industry and is significantly less expensive than acetone-soluble nitrocellulose. Typical acetone-soluble nitrocellulose is, for example, guncotton or pyrocotton. Acetone-soluble nitrocellulose is frequently sold as E-cotton (ester-soluble cotton) while alcohol-soluble nitrocellulose is frequently sold as A-cotton.

Depending on the energy carrier being used, it can be advantageous to use a low-viscosity alcohol-soluble nitrocellulose or a high-viscosity alcohol-soluble nitrocellulose. In the case of a high proportion of a crystalline energy carrier such as RDX, the use of a low-viscosity alcohol-soluble nitrocellulose is advantageous. A low-viscosity alcohol-soluble nitrocellulose has a viscosity of less than 425 cP at 20° C. and 34% by weight of nitrocellulose having a nitrogen content of 11.7% dissolved in acetone. A high-viscosity alcohol-soluble nitrocellulose has a viscosity of less than 425 cP at 20° C. and 18% by weight of nitrocellulose having a nitrogen content of 11.7% dissolved in acetone. In the case of a propellant having a low power, it is also possible to use an alcohol-soluble nitrocellulose having a nitrogen content of 11.3% and a viscosity of less than 450 cP at 9% by weight of nitrocellulose dissolved in acetone or less than 425 cP at 23% by weight of nitrocellulose dissolved in acetone.

A further significant advantage in the production of the propellant when using the alcohol-soluble nitrocellulose, in particular with the simultaneous use of an alcohol-moist energy carrier, is that the energy carrier does not have to be subjected to time-consuming and energy-intensive drying. Furthermore, there is not the risk of agglomerate formation which is frequently present when using water-moist energy carriers, in particular RDX. The absence of the need for drying and the lower price of the alcohol-soluble nitrocellulose makes production of the propellant according to the invention up to 30% less expensive than the production of propellants known heretofore.

A further advantage of the propellant of the invention is that the flowability of the mixture of the components can be ensured by the addition of ethanol during production of the propellant even in the case of a very high proportion of a crystalline energy carrier such as RDX. The flowability is of critical importance for the extrusion usually used in the processing of the mixture for producing the propellant. In addition, process control when using ethanol as a solvent is simpler and more accurate than when using acetone as a solvent. However, ethanol can only be employed as solvent when using alcohol-soluble nitrocellulose.

The alcohol-soluble nitrocellulose makes it possible to produce the propellant of the invention batchwise in a kneader or in a press in a "powder with solvent" process (PwS process) or a "powder without solvent" process (PwoS process). In the PwoS process, water-moist material is employed. In this case, the cellulose acetate butyrate should be processed with alcohol-moist nitrocellulose to form a granular base material which is then mixed into the water-moist composition and processed with simultaneous dewatering and plasticization to give a PwoS powder. This can be carried out by using a shear roller to give a dewatered, plasticized granular material which is then processed through the use of a twin-screw extruder to give a propellant of the desired geometry.

In accordance with another feature of the invention, the nitrocellulose is preferably present in the propellant in a concentration of from 15% by weight to 48% by weight, in particular from 20% by weight to 35% by weight, in particular from 22% by weight to 28% by weight.

This nitrocellulose concentration has been found to be particularly advantageous in order to be able to set the cellulose acetate butyrate concentration to such a value that a relatively insensitive but still high-energy propellant can be provided thereby.

In accordance with a further feature of the invention, preference is given to at least 80% by weight, in particular at least 90% by weight, in particular at least 95% by weight, in particular 100% by weight, of the nitrocellulose being alcohol-soluble nitrocellulose.

In accordance with an added feature of the invention, the nitrogen content of the nitrocellulose can be from 11.2% to 12.8%, in particular from 11.6% to 12.7%. The degree of substitution of the nitrocellulose is indicated indirectly by the nitrogen content based on dry matter. The nitrogen content when all three positions of an anhydroglucose unit are substituted is theoretically 14.14%. However, a nitrogen content of only about 13.6% can be achieved in practice.

In accordance with an additional feature of the invention, the cellulose acetate butyrate is preferably present in the propellant in a concentration of at least 2% by weight, in particular in a concentration of from 2% by weight to 14% by weight, in particular in a concentration of from 3% by weight to 8% by weight, in particular in a concentration of from 3.5% by weight to 6% by weight.

In accordance with yet another feature of the invention, the cellulose acetate butyrate in the propellant can have a melting point of over 200° C. and a glass transition temperature of over 130° C. The cellulose acetate butyrate preferably has a melting point of over 230° C. and a glass transition temperature of over 160° C.

In accordance with yet a further feature of the invention, the energy carrier can be an energy carrier present in crystalline form. In one exemplary embodiment, the energy carrier is hexogen (RDX), octogen (HMX), nitroguanidine, FOX-7 (1,1-diamino-2,2-dinitroethylene), FOX-12 (guanylurea dinitramide) or ADN (ammonium dinitramide). The energy carrier is preferably present in the propellant in a concentration of from 11% by weight to 69% by weight, in particular from 25% by weight to 55% by weight, in particular from 35% by weight to 45% by weight.

In accordance with yet an added feature of the invention, at least one stabilizer, in particular magnesium oxide, diphenylamine, diphenylurethane, N,N-diphenylurea (arkadit I), N-methyl-N,N-diphenylurea (arkadit II), 1,3-diethyl-1',3'-diphenylurea (centralite I), 1,3-dimethyl-1',3'-diphenylurea (centralite II) or N-methyl-N'-ethyl-N,N'-diphenylurea (centralite III) can be present in the propellant. In addition, at least one muzzle flash suppressor, in particular a cryolite, sodium oxalate, potassium sulphate, potassium nitrate, another potassium salt or a mixture of at least two of the substances mentioned, can be present in the propellant. The stabilizer and the muzzle flash suppressor can be present in the propellant in a total concentration of from about 2% by weight to 6% by weight.

In accordance with yet an additional feature of the invention, preference is given to at least one, in particular energy-rich, plasticizer, in particular bis(2,2-dinitropropyl)acetal/formal (BDNPA/F) or a dinitrodiaza compound, being present in the propellant. The plasticizer particularly preferably is formed of the following components:

from 30% by weight to 50% by weight of 2,4-dinitro-2,4-diazapentane, from 35% by weight to 55% by weight of 2,4-dinitro-2,4-diazahexane and from 0% by weight to 30% by weight of 2,4-dinitro-2,4-diazaheptane.

A plasticizer formed of these components is referred to as DNDA 5,7.

In accordance with again another feature of the invention, the plasticizer can be present in the propellant in a concentration of from 9% by weight to 39% by weight, in particular from 14% by weight to 34% by weight, in particular from 29% by weight to 19% by weight. The plasticizers mentioned make it possible to produce a propellant in which upon firing the maximum pressure arising and the projectile velocity obtained depend only slightly on the temperature of the propellant. As a result, firing of gun ammunition at virtually constant values of maximum pressure and projectile velocity in a temperature range from −50° C. to +70° C. is made possible.

In accordance with again a further feature of the invention, at least one energy-rich further binder, in particular poly-3-nitratomethyl-3-methyloxetane (polyNIMMO), polyglycidyl nitrate ester (polyglyn), glycidyl azide polymer (GAP), poly-3-azidomethyl-3'-methyloxetane (AMMO), poly-3,3'-bisazidomethyloxetane (BAMO) or a mixture thereof, or a further binder which is not energy-rich, in particular polybutadiene having terminal hydroxyl groups (HTPB), can be present in the propellant. The propellant of the invention can be present in the form of shaped bodies or granular material. The granular material is frequently also referred to as propellant powder.

With the objects of the invention in view, there is also provided a process for producing a propellant for guns. The process comprises adding a prefabricated mixture containing cellulose acetate butyrate and alcohol-soluble nitrocellulose to a mixture containing at least one energy carrier, to produce the propellant according to the invention. The addition can be effected during kneading of the mixture. This makes simple processing possible.

In accordance with another mode of the invention, the mixture preferably additionally contains acetone-soluble nitrocellulose, at least one stabilizer, at least one muzzle flash suppressor, at least one plasticizer and/or at least one further binder which may be energy-rich or not energy-rich.

In accordance with a concomitant mode of the invention, the mixture can be processed water-moist and with thermal plasticization. Thermal plasticization can be carried out at temperatures of from 55° C. to 100° C.

Other features which are considered as characteristic for the invention are set forth in the appended claims.

Although the invention is illustrated and described herein as embodied in a propellant and a process for producing a propellant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying examples.

DETAILED DESCRIPTION OF THE INVENTION

The invention will be illustrated below with the aid of examples.

The propellant of the invention can be present in the form of the following formulations:

Formulation A

| | % by weight |
|---|---|
| RDX | 52 +/− 14 |
| DNDA 5, 7 | 20 +/− 7 |
| NC | 22 +/− 7 |
| CAB | 4 + 3/−2 |
| Additives, e.g. stabilizers and muzzle flash suppressors | 2 + 1/−0 |

Formulation B

| | % by weight |
|---|---|
| RDX | 43 +/− 12 |
| DNDA 5, 7 | 27 +/− 6 |
| NC | 26 +/− 6 |
| CAB | 4 + 2/−0 |
| Additives, e.g. stabilizers and muzzle flash suppressors | 2 + 1/−0 |

Formulation C

| | % by weight |
|---|---|
| RDX | 44.8 +/− 12 |
| DNDA 5, 7 | 26 +/− 6 |
| NC | 25 +/− 6 |
| CAB | 2 + 2/−0 |
| Additives, e.g. stabilizers and muzzle flash suppressors | 2.2 + 1/−0 |

Formulation D

| | % by weight |
|---|---|
| RDX | 44.8 +/− 12 |
| DNDA 5, 7 | 23 +/− 6 |
| NC | 22 +/− 6 |
| CAB | 8 + 0/−4 |
| Additives, e.g. stabilizers and muzzle flash suppressors | 2.2 + 1/−0 |

For all formulations mentioned:

The nitrocellulose (NC) can be an alcohol-soluble nitrocellulose or a mixture of alcohol-soluble and acetone-soluble nitrocellulose.

It is advantageous for the RDX to be coated with alcohol-soluble nitrocellulose before mixing into the other components of the formulation. This coating step can be carried out using about 5% of the nominal nitrocellulose content of the respective formulation. The formulation which has at the end been shaped to give shaped bodies or a granular material can, in particular to avoid static charges and to reduce friction, be coated with about 0.02% by weight of graphite.

Technology 1

In order to produce propellants of low power, i.e. having energy densities below 1100 J/g, exclusively alcohol-soluble nitrocellulose is used in all of the above formulations.

The following technologies 2 and 3 can be used in order to produce propellants of higher power.

Technology 2

The RDX is used in alcohol-moist form, i.e. wetted with from about 20% by weight to 30% by weight of ethanol. It is mixed with the total cellulose acetate butyrate (CAB) provided in the formulation and from 5% by weight to 10% by weight of the total mass of the alcohol-soluble nitrocellulose formulation and the mixture is kneaded in a batch kneader. Plasticization occurs as a result of the alcohol wetting the RDX. The non-alcohol-soluble cellulose acetate butyrate is not dissolved. The proportion of nitrocellulose which is provided according to the respective formulation and has not yet been added is subsequently added in the form of acetone-soluble nitrocellulose, which has a higher degree of nitration than the alcohol-soluble nitrocellulose and has a higher nitrogen content than the latter, together with DNDA 5,7 and the additives and the mixture is mixed further. Finally, a small amount of acetone is added. The mixed composition is then extruded through the use of an extruder having a suitable die and a built-in needle carrier. The needle carrier results in formation of extrudates having, for example, a 1-hole, 7-hole or 19-hole geometry in cross section. The extrudate is brought to the desired size by cutting. The shaped bodies formed are finally dried at from 30° C. to 60° C.

Technology 3

Exclusively alcohol-soluble nitrocellulose or an alcohol-plasticized mixture of alcohol-soluble and alcohol-insoluble nitrocellulose and also DNDA 5,7 and additives are added to RDX wetted with from 20% by weight to 30% by weight of ethanol and the cellulose acetate butyrate and the mixture is mixed in a batch kneader. The mixture is only plasticized by addition of further alcohol. The mixed composition is then, as described in Technology 2, processed further by extrusion, subsequent cutting and drying.

Technology 4

Alcohol-moist RDX, alcohol-soluble nitrocellulose with cellulose acetate butyrate and the additives, DNDA 5,7 and further alcohol are metered in a single-stream process into a corotating twin-screw extruder, plasticized in the extruder and extruded continuously as extrudates having a 1-hole, 7-hole or 19-hole geometry in cross section through the use of suitable dies. The extrudates formed are cut to give shaped bodies and dried.

Technology 5

As described under Technology 2, an intermediate product is produced from alcohol-moist RDX, cellulose acetate butyrate and a small proportion of alcohol-soluble nitrocellulose.

This intermediate product is added to a non-alcohol-soluble, water-moist nitrocellulose (nitrocellulose wetted with from about 20% by weight to 30% by weight of water) having a nitrogen content of over 12.5% and also DNDA 5,7, RDX and additives and wetted with further water so that a water content of from 20% by weight to 30% by weight is achieved.

The water-moist composition is applied to a continuously operating shear roller.

At least one gravimetric metering balance with blade screw or spiral discharge or a conveyor belt is suitable for this purpose. On the shear roller, the water-moist composition is plasticized through the use of heat and friction and continuously processed through the use of a granulating ring with knife scraper to give plasticized granular material.

This granular material can be fed continuously into a corotating twin-screw extruder and can then be processed without addition of solvents to give propellant extrudates and subsequently dried.

The granular material can likewise be fed to a simultaneous or fine roller, with a plasticized sheet being obtained purely by action of heat and friction.

This is rolled up into a roll which is then processed to give extrudates in a heated extruder.

The temperature for processing the water-moist raw composition containing DNDA 5,7 is in the range from 60° C. to 90° C. for the shear roller, the roll mill and the extruder.

Technology 5 can also be modified in such a way that only water-moist RDX is used and the alcohol-soluble nitrocellulose (A-NC) is only thermally plasticized with DNDA 5,7 and cellulose acetate butyrate.

The invention claimed is:

1. A propellant for guns, the propellant comprising:

at least one energy carrier;

cellulose acetate butyrate having a melting point of over 200° C. and a glass transition temperature of over 130° C., said cellulose acetate butyrate having a concentration of from 2% by weight to 14% by weight in the propellant; and nitrocellulose, at least part of said nitrocellulose being alcohol-soluble nitrocellulose, said nitrocellulose being present in a concentration of at least 15% by weight in the propellant to serve as a binder, and at least 80% by weight of said nitrocellulose being alcohol-soluble nitrocellulose; and at least one plasticizer formed of the following components:

from 30% by weight to 50% by weight of 2,4-dinitro-2,4-diazapentane, from 35% by weight to 55% by weight of 2,4-dinitro-2,4-diazahexane, and from 0% by weight to 30% by weight of 2,4-dinitro-2,4-diazaheptane;

said cellulose acetate butyrate and said nitrocellulose in combination reducing brittle fracture of the propellant.

2. The propellant according to claim 1, wherein said nitrocellulose is present in a concentration of from 15% by weight to 48% by weight in the propellant.

3. The propellant according to claim 1, wherein said nitrocellulose is present in a concentration of from 20% by weight to 35% by weight in the propellant.

4. The propellant according to claim 1, wherein said nitrocellulose is present in a concentration of from 22% by weight to 28% by weight in the propellant.

5. The propellant according to claim 1, wherein at least 90% by weight of said nitrocellulose is alcohol-soluble nitrocellulose.

6. The propellant according to claim 1, wherein at least 95% by weight of said nitrocellulose is alcohol-soluble nitrocellulose.

7. The propellant according to claim 1, wherein 100% by weight of said nitrocellulose is alcohol-soluble nitrocellulose.

8. The propellant according to claim 1, wherein said nitrocellulose has a nitrogen content of from 11.2% to 12.8%.

9. The propellant according to claim 1, wherein said nitrocellulose has a nitrogen content of from 11.6% to 12.7%.

10. The propellant according to claim 1, wherein said cellulose acetate butyrate is present in a concentration of from 3% by weight to 8% by weight in the propellant.

11. The propellant according to claim 1, wherein said cellulose acetate butyrate is present in a concentration of from 3.5% by weight to 6% by weight in the propellant.

12. The propellant according to claim 1, wherein said cellulose acetate butyrate has a melting point of over 230° C. and a glass transition temperature of over 160° C.

13. The propellant according to claim 1, wherein said energy carrier is present in crystalline form.

14. The propellant according to claim 1, wherein said energy carrier is hexogen (RDX), octogen (HMX), nitroguanidine, FOX-7 (1,1-diamino-2,2-dinitroethylene), FOX-12 (guanylurea dinitramide) or ADN (ammonium dinitramide).

15. The propellant according to claim 1, wherein said energy carrier is present in a concentration of from 11% by weight to 69% by weight in the propellant.

16. The propellant according to claim 1, wherein said energy carrier is present in a concentration of from 25% by weight to 55% by weight in the propellant.

17. The propellant according to claim 1, wherein said energy carrier is present in a concentration of from 35% by weight to 45% by weight in the propellant.

18. The propellant according to claim 1, which further comprises at least one stabilizer.

19. The propellant according to claim 18, wherein said at least one stabilizer is magnesium oxide, diphenylamine, diphenylurethane, N,N-diphenylurea (arkadit I), N-methyl-N,N-diphenylurea (arkadit II), 1,3-diethyl,-1',3'-diphenylurea (centralite I), 1,3-dimethyl-1',3'-diphenylurea (centralite II) or N-methyl-N'-ethyl-N,N'-diphenylurea (centralite III).

20. The propellant according to claim 1, which further comprises at least one muzzle flash suppressor.

21. The propellant according to claim 20, wherein said at least one muzzle flash suppressor is a cryolite, sodium oxalate, potassium sulphate, potassium nitrate, another potassium salt or a mixture of at least two of a cryolite, sodium oxalate, potassium sulphate, potassium nitrate or another potassium salt.

22. The propellant according to claim 1, which further comprises at least one energy-rich plasticizer.

23. The propellant according to claim 22, wherein said at least one energy-rich plasticizer is bis(2,2-dinitropropyl)acetal/formal (BDNPA/F) or a dinitrodiaza compound.

24. The propellant according to claim 1, wherein said at least one plasticizer is present in a concentration of from 9% by weight to 39% by weight in the propellant.

25. The propellant according to claim 1, wherein said at least one plasticizer is present in a concentration of from 14% by weight to 34% by weight in the propellant.

26. The propellant according to claim 1, wherein said at least one plasticizer is present in a concentration of from 29% by weight to 19% by weight in the propellant.

27. The propellant according to claim 1, which further comprises at least one energy-rich further binder.

28. The propellant according to claim 27, wherein said at least one energy-rich further binder is poly-3-nitratomethyl-3-methyloxetane (polyNIMMO), polyglycidyl nitrate ester (polyglyn), glycidyl azide polymer (GAP), poly-3-azidomethyl-3'-methyloxetane (AMMO), poly-3,3'-bisazidomethyloxetane (BAMO), a mixture thereof, or a further binder which is not energy-rich.

29. The propellant according to claim 28, wherein said further binder which is not energy-rich is polybutadiene having terminal hydroxyl groups (HTPB).

30. The propellant according to claim 1, wherein the propellant is present in the form of shaped bodies or a granular material.

31. A process for producing a propellant for guns, the process comprising the following steps:

providing a mixture containing at least one energy carrier; and adding a prefabricated mixture containing cellulose acetate butyrate and alcohol-soluble nitrocellulose to the mixture containing at least one energy carrier to produce the propellant according to claim 1.

32. The process according to claim 31, wherein the mixture contains acetone-soluble nitrocellulose, at least one stabilizer, at least one muzzle flash suppressor, at least one plasticizer and/or at least one further binder which may be energy-rich or not energy-rich.

33. The process according to claim 13, which further comprises processing the mixture to be water-moist and have thermal plasticization.

* * * * *